United States Patent [19]

Lowe

[11] 4,071,156

[45] Jan. 31, 1978

[54] CHILD RESISTANT CONTAINER-CLOSURE ASSEMBLY

[75] Inventor: Allen D. Lowe, Montoursville, Pa.

[73] Assignee: The West Company, Phoenixville, Pa.

[21] Appl. No.: 714,019

[22] Filed: Aug. 13, 1976

[51] Int. Cl.[2] ..... B65D 55/02; B65D 85/56

[52] U.S. Cl. ..... 215/224; 215/206; 215/223; 215/256

[58] Field of Search ..... 215/206, 223, 224, 256, 215/341, 344

[56] References Cited

U.S. PATENT DOCUMENTS

| | | | |
|---|---|---|---|
| 3,817,418 | 6/1974 | Mastrovito | 215/344 X |
| 3,871,662 | 3/1975 | Hepp et al. | 215/224 X |
| 3,901,401 | 8/1975 | Lynn et al. | 215/224 X |
| 3,974,929 | 8/1976 | Montgomery | 215/256 X |
| 3,980,194 | 9/1976 | Costa | 215/223 |

*Primary Examiner*—George T. Hall

*Attorney, Agent, or Firm*—Eugene E. Renz, Jr.

[57] ABSTRACT

A closure for a container having a neck with an access opening therein and means defining a locking rib on the outer surface of the neck interrupted at least at two circumferentially spaced locations to define gaps therein or predetermined differing arcuate dimensions, said closure including a cap having a top, a skirt depending from the outer edge of the top and at least a pair of primary locking lugs projecting radially inwardly from the skirt which in all positions, except one, engage under said locking rib to secure the cap in place, said primary lugs being of an arcuate span and circumferential spacing to register with said gaps in said one position and at least one auxiliary releasable locking lug of a shallower radial projection than said primary lugs engaging under said bead when said cap is in said one position, said auxiliary lug operable to snap over said bead in said one position when said cap is tilted relative to the neck of the container.

21 Claims, 14 Drawing Figures

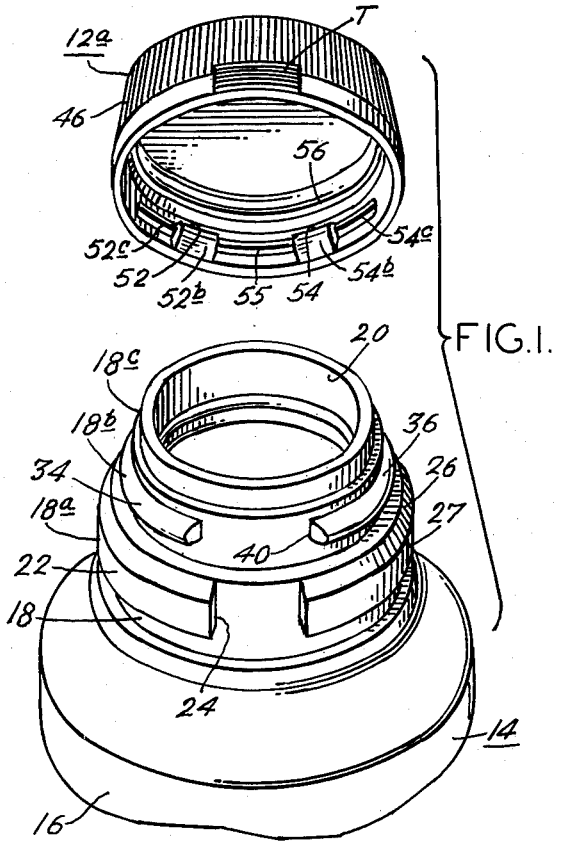
FIG. 1.
FIG. 2.
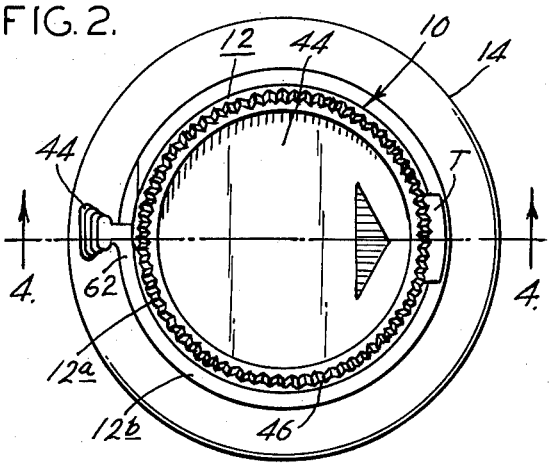
FIG. 3.
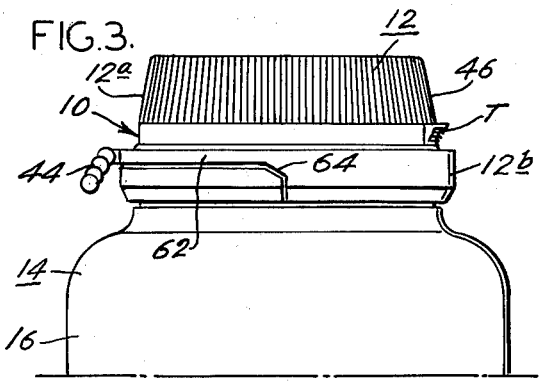
FIG. 4
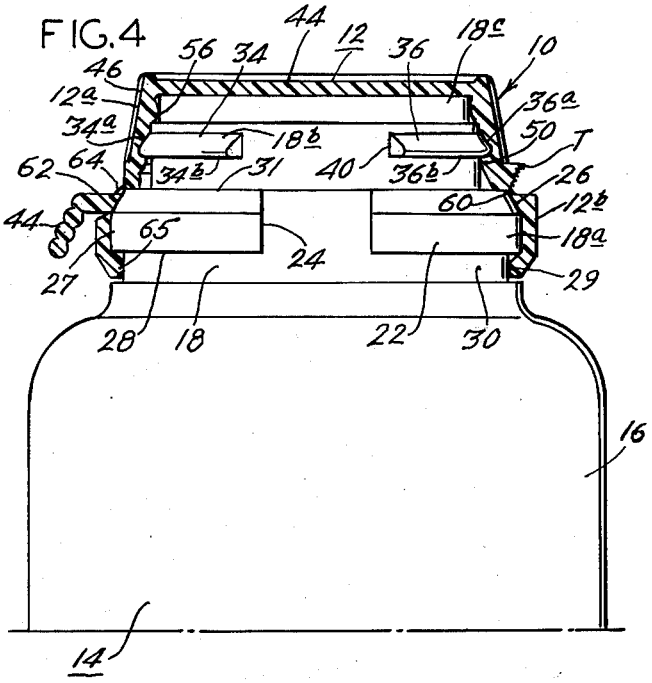
FIG. 5.
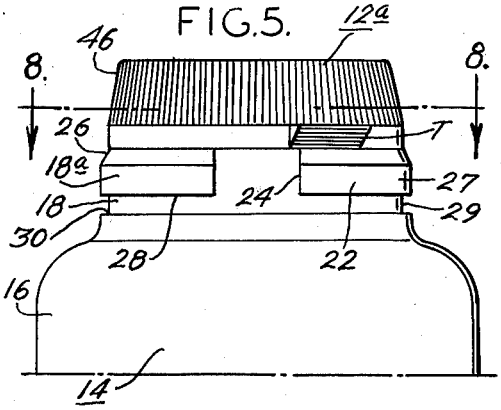
FIG. 6.
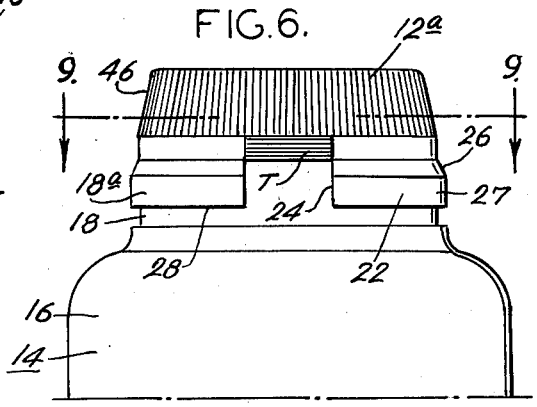

CHILD RESISTANT CONTAINER-CLOSURE ASSEMBLY

BACKGROUND OF THE INVENTION

The present invention relates to container-closure assemblies. More particularly, the invention relates to a so-called "child resistant" container-closure assembly for substances which may be harmful to children and which is designed to prevent opening by a child and yet is manipulatable by adults to remove the closure for access to the container contents. These assemblies are typically used for medicines such as aspirin which in themselves are not harmful but which can present a serious risk to a child if ingested in even moderate quantities.

Child resistant container-closure assemblies are not new per se. Existing assemblies of this type generally comprise a cap made of a resilient plastic material having locking means in the form of lugs, which engage under a rib on the container in one position to secure the cap against removal. The cap, however, is rotatable relative to the container neck to position the lugs in registry with one or more complementary gaps in the container rib and thereby permit removal. The cap and container usually are provided with visible indicia which when aligned present a visual means to the user that the lugs are in registry with the gaps and the cap can be removed. This type of assembly is shown in the U.S. patent to Horvath, No. 3,669,295, issued June 13, 1972. In Horvath the lugs depend from the top of the cap and are spaced radially inwardly from the skirt to engage an internal rib in the container neck and the skirt is provided with a bead at its lower edge which snaps over a bead on the exterior wall of the neck of the container.

Assemblies of this type posses certain disadvantages and drawbacks. For example, since the lower edge of the skirt is exposed, it presents an accessible gripping edge for forcing cap removal. The cap is also susceptible to release by prying with an instrument which is easily engaged under the exposed lower edge of the skirt. The skirt bead and container bead extend the full circumference of the cap and container. Accordingly, the cap and container beads must be matched within narrow tolerance limits to function properly and it has been found that these tolerances are difficult to hold in mass produced assemblies. If the fit is too tight, cap removal is extremely difficult, even for adults, particularly elderly persons. On the other hand, a loose fit permits easy removal by the customary twist and pull techniques employed by young children.

Other safety closures which are snap cap arrangements are shown in the Grimm patent, No. 3,393,816, issued July 23, 1968, the U.S. Patent to Horvath, No. 3,812,989, issued May 28, 1974, the U.S. Patent to Berghahn, No. 3,757,979, issued Sep. 11, 1973, and the U.S. Patent to O'Donnell, No. 3,170,585, issued Feb. 23, 1965. These assemblies basically comprise a cap made of resilient material, such as plastic, having a locking rib which normally engages under a bead on the container neck. In some instances the cap has a discrete locking tab which registers with a gap in the bead on the container in the removal position for the cap. In each case visible, exposed indicia means are provided for registering the locking tab with the gap in the bead on the container neck. It has been found that these assemblies are likewise difficult to remove in some instances, even by adults, and furthermore, the alignment of the indicia means can be deciphered in some cases even by children.

With the foregoing in mind, the present invention provides a truly tamperproof container-closure assembly which is virtually impossible for young children to open and which nevertheless is relatively easily manipulatable by adults to position for opening when it is desired to gain access to the contents of the container. To this end the closure cap, which may be made of a resilient plastic material, is provided with a series of primary locking lugs on the interior side wall of the skirt and also a series of auxiliary lugs of a shallower radial depth than the primary lugs, which in the preferred embodiment, extend for a predetermined circumferential distance on either side of the primary lugs. The container neck is provided with a complementary bead interrupted at circumferentially spaced locations to define gaps of a slightly greater arc than the primary locking lugs on the cap so that the lugs may pass through the gaps in the release position. The circumferential spacing of the primary lugs and gaps are such that they register in only one position. By this arrangement, even when the primary lugs are in registry, the auxiliary lugs, which engage under the bead on the container, present a predetermined relatively small resistance to removal of the cap so that even if a young child were to align the primary lugs with the gaps by design or accidentally, the cap could not be easily removed if it were pulled in an axial direction. Cap removal is affected by engaging a thumb tab on the exterior of the cap side wall and pivoting the cap relative to the container. The lower edge of the skirt closely overlies a radial shoulder on the container neck to prevent removal by a prying action.

The assembly further includes a safety tear band connected to the lower edge of the skirt of the cap by fracturable means which tear band has a continuous circumferentially extending rib engaging under a locking band below the bead on the container neck. The band is interrupted to define an indicia slot or space for aligning the thumb tab to position the primary locking lugs in registry with the gaps for removal of the cap. The tear band normally overlies the gap and thus one element of the alignment indicia means is covered or not exposed prior to removal of the tear band. The lower edge of the tear band closely overlies a radial abutment surface on the container neck to prevent prying of the closure by use of an instrument. Thus, the present assembly is truly tamperproof and child resistant. The assembly also includes other features including sealing means for preserving the contents against deterioration.

The container and closure of the present invention lend themselves to mass production techniques and the cap and container are designed to be assembled by automatic equipment. Thus, the assembly is truly economical. Further, the tolerance to provide a truly child resistant assembly which is comparatively easy for adults to understand and operate are not as critical as in prior assemblies discussed above.

BRIEF DESCRIPTION OF THE DRAWINGS

These and other objects and features of the invention will be more readily understood upon consideration of the following detailed description, taken in connection with the accompanying drawings, in which:

FIG. 1 is a perspective view of a child resistant container-closure assembly in accordance with the present invention, only the upper portion of the container being shown;

FIG. 2 is a top plan view of the assembly with the closure in place on the container;

FIG. 3 is a side elevational view of the container-closure assembly of FIG. 2;

FIG. 4 is an enlarged side elevational view with the closure broken away to show the internal portions thereof engaging with the container finish;

FIG. 5 is a side elevational view similar to FIG. 3 with the lower tear band portion of the closure removed;

FIG. 6 is a view similar to FIG. 5 with the closure rotated to a position for removal from the container;

DESCRIPTION OF SPECIFIC EMBODIMENT

Figure 7:
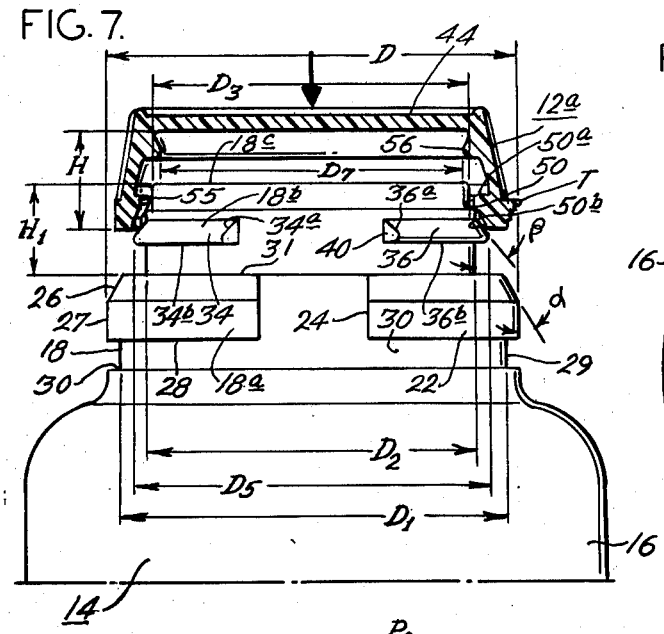
FIG. 7 is an enlarged view similar to FIG. 4 showing the closure in position to be applied to the container.
Figure 8:
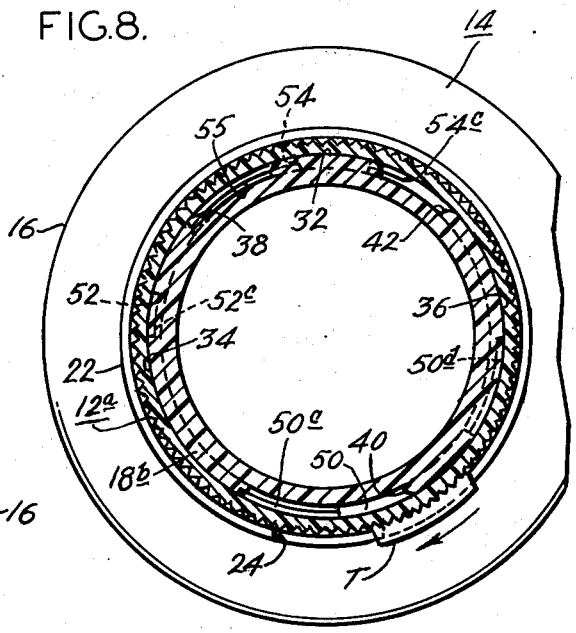
FIGS. 8 and 9 are sectional views taken on lines 8—8 and 9—9 of FIGS. 5 and 6, respectively.

Referring now to the embodiment of the invention illustrated in the figures by way of example only, the numeral 10 designates in its entirety a container-closure assembly in accordance with the present invention. The closure 12 which comprises a cap portion 12$^a$ and a detachable tear band portion 12$^b$ is preferably of a thermoplastic material which may be characterized as semi-rigid and yet has sufficient flexibility and yieldability to permit deflection of some of the parts of the cap when it is applied to the container 12 by a snap action as explained in more detail below. A variety of thermoplastic resins are known in the art which are useful for this purpose. These include high and low density polyethylene, polypropylene, polystryrene and polyvinylchloride. The container 14 may be made of a similar material or glass. The closure 12 and container 14 are each preferably molded by conventional techniques.

Considering broadly the basic components of the container-closure assembly of the present invention in terms of function, the cap portion is provided with a series of internal primary locking lugs which register in only one position with gaps in a locking bead on the container neck portion to permit removal of the cap and which in all other angular positions relative to the container engage under the bead to normally seat the cap in a locked position on the container. The locking lugs and gaps are circumferentially spaced in a predetermined array so that the locking points are generally equispaced circumferentially thereby minimizing the possibility of prying the cap from the container in the locked position. The cap is also provided with auxiliary locking lugs which underlie the locking bead on the container neck even when the primary lugs are in registry with the gaps, thereby offering resistance to removal of the cap by a pulling action typical of what small children do to remove a cap and yet easily bypass the locking bead when a tilting action is exerted on the cap to remove it. The tear band formed integrally with the cap normally overlies indicia means on the container with which the indicia means on the cap must be aligned to register the lugs or gaps for removal of the cap. This is an added handicap to some children who may be aided by exposed indicia means characteristic of some prior assemblies. In accordance with the present invention the cap and tear band abut or closely overlie peripheral shoulders on the container neck thus discouraging removal of the closure by prying with an instrument, such as a finger nail file or the like. As explained in more detail hereinafter, the parts mate in a particular fashion to provide a good seal protecting the contents of the container against deterioration.

Considering now the assembly in greater detail, the container 14 illustrated has a body portion 16 of elongated, generally tubular configuration which terminates at its upper end in a stepped neck 18 of reduced diameter and defining at its outer terminal end an access opening 20. The stepped neck 18 comprises, in the present instance, a lower section 18$^a$, an intermediate section 18$^b$ and an upper terminal section 18$^c$. The lower section 18$^a$ of the neck has an annular radially outwardly projecting band 22 which extends for almost the entire circumference of the neck and is interrupted to define an indicator gap 24. The band 22 has a sloping upwardly convergent surface 26, disposed at a predetermined angle $\alpha$ of about 30° to the axis of the container, a generally cylindrical side wall 27 of a predetermined diameter D below the sloping surface 26 which terminates at its lower edge in a circumferential radially directed shoulder 28. The shoulder 28 is axially spaced from an annular radial wall 29 at the base of the neck to define therebetween an annular groove 30 of a smaller diameter $D_1$ than the diameter D of side wall 27 to secure the tear band portion 12$^b$ of the closure in place on the container in a given manner and for purposes explained in more detail below. The juncture of the lower section 18$^a$ and intermediate section 18$^b$ defines a circumferentially extending radial abutment shoulder 31.

The intermediate portion 18$^b$ of the neck is of a smaller diameter $D_2$ than the lower portion 18$^a$ and is provided with radially outwardly directed, circumferentially spaced locking ribs, in the present instance, three in number, designated 32, 34 and 36. These locking ribs are disposed in a predetermined array in the manner illustrated in FIG. 10 to define a series of circumferentially spaced arcuate recesses or gaps 38, 40 and 42 between the locking ribs. In the present instance, the arcuate gaps 38 and 42 are approximately equal and subtended by angles A and B, respectively, having a vertex at the axis of the container and the arcuate gap 40 is subtended by a greater angle C. Additionally, as shown, the gaps 38 and 42 are equispaced angularly on opposite sides of a plane P passing through the axis of the container and bisecting the gap 40. Thus, the rib 32 is bisected by the plane P and the ribs 34 and 36 lie in semi-circular segments $S_1$ and $S_2$ on either side of the plane P. The arcuate ribs 34 and 36 are approximately equal and subtended by angles E and F and the arcuate rib 32 is subtended by a greater angle G. The gaps 38 and 42 are disposed in a circular segment $S_3$ to one side of a plane $P_1$ transverse to the plane P and the gap 40 is in the opposite semi-circular segment $S_4$. The gaps 38 and 42 are mirror images of one another and lie in adjacent quadrants Q1 and Q2 defined by the intersecting planes $P_1$ and $P_2$.

The locking ribs 32, 34 and 36 each have an upwardly convergent sloping surface 32$^a$, 34$^a$ and 36$^a$, preferably disposed at a greater angle $\beta$ than the sloping surface 26 of the band 22. The outer edges of the locking ribs lie on a common circle $C_a$ having a diameter $D_5$ preferably smaller than the diameter D of the band 22. The sloping surfaces 32$^a$, 34$^a$ and 36$^a$ terminate in a lower radially directed wall 32$^b$, 34$^b$ and 36$^b$ forming an abutment shoulder which lugs on the cap engage in the locked position.

The outer surface of the terminal neck portion 18$^c$ is of a slightly reduced diameter $D_3$ to provide a good sealing surface for the cap when it is applied to prevent ingress of moisture and preserve the container contents against deterioration.

The closure as illustrated comprises a cap portion 12$^a$ and a tear band portion 12$^b$ connected by a weakened section and a hand grip tab 44 to facilitate removal of the tear band portion when it is desired to manipulate the cap to a position for removal from the container as explained in more detail below.

Figure 9:
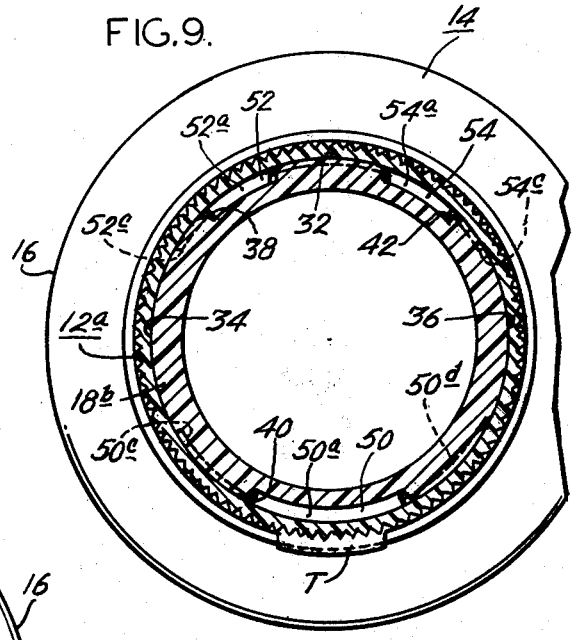

The cap portion consists of a disc-like top 44 having a skirt 46 depending from its outer peripheral edge, the outer surface of the skirt being ribbed to facilitate gripping by the user to rotate the cap to a position where it can be removed from the container. (FIGS. 6 and 9).

The inner surface of the skirt 46 is provided with a series of radially inwardly projecting, circumferentially spaced primary locking lugs of arcuate shape which are selectively sized and spaced about the inner periphery of the skirt so that they register in only one position with the gaps in the container neck to permit removal of the cap. To this end there are three locking lugs 50, 52 and 54, the arcuate lugs 52 and 54 being approximately equal and subtended by angles $A_1$ and $B_1$, having a vertex at the center of the cap which are slightly smaller than the angles A and B of the complementary gaps or slots 38 and 42 in the container neck. The lug 50 subtends an angle $C_1$, greater than angles A or B of lugs 52 and 54 and slightly less than the angle C of the gap 40. The gaps extend angularly a slightly greater dimension than the lugs to permit passage through the gaps in the release position. The relative angular disposition of the lugs is substantially the same as the gaps or slots in the container. Thus, the arcuate lugs 52 and 54 are separated by an arc subtended by angle $K_1$ and are disposed in one semi-circular segment $S_5$ defined by a plane $P_3$ through the axis of the cap and the lug 50 lies in the opposite segment $S_6$. Further, the lugs 52 and 54 are in adjacent quadrants Q3 and Q4 of sector $S_5$, defined by a plane $P_4$ transverse to Plane $P_3$. This arrangement provides three generally equispaced locking areas thus minimizing the chance of prying the cap open in all relative angular positions, except the one position where the primary locking lugs are in registry with the release gaps in the container neck.

Each of the locking lugs 50, 52 and 54 has a generally radial top surface 50$^a$, 52$^a$ and 54$^a$ which confronts and engages under the shoulder of the radial wall of the nib segments on the container neck when the lugs are out of registry with the slots to normally seat the cap in a locked position. The top surfaces 50$^a$, 52$^a$ and 54$^a$ may be slightly inwardly inclined at approximately a 5° angle and the lower wall of the locking ribs are likewise slightly tapered upwardly at about a 5° angle to snub the cap to a fully seated position and offer a slight controlled resistance to turning the cap relative to the neck. To this end the inner edge of the lugs lie on the periphery of a common circle $C_b$ having a diameter $D_4$ less than the diameter $D_5$ of the circle $C_2$ of the ribs 32, 34 and 36. Each of the locking lugs also has a diverging downwardly and outwardly cam surface 50$^b$, 52$^b$ and 54$^b$ at an angle $\delta$ of about 30° so that when the cap is applied to the container in the manner shown in FIG. 7, the cap may be pressed to a seated position on the container simply by exerting an axial force on the top of the cap, the skirt being of a sufficient resiliency to permit slight expansion for engagement of the locking lugs over the locking rib in any relative angular position of the cap and container.

Figure 10:
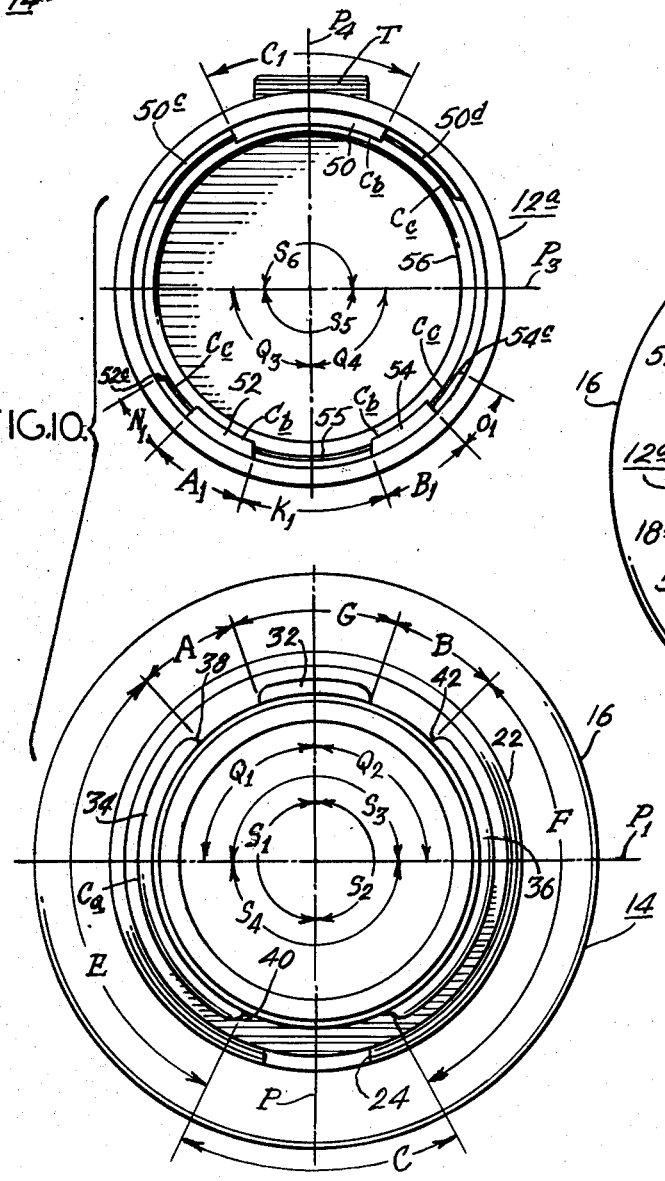
FIG. 10 is a combined top plan view of the container looking into the open discharge end and a bottom plan view of the closure showing the interior thereof.
Figure 13:
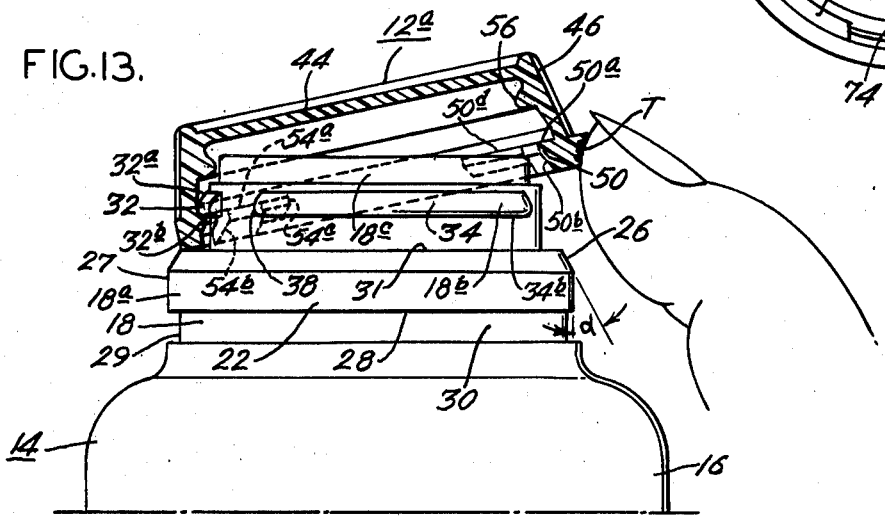
FIG. 13 is a transverse sectional view of the cap as is being disengaged from the container neck.

An important feature of the present invention is the provision of auxiliary locking means on the cap providing a force resisting removal of the cap even when the locking lugs of the cap are in registry with their respective gaps in the container neck. This auxiliary locking means comprises, as best illustrated in FIGS. 1 and 10, auxiliary lugs associated with each of the main locking lugs which are of a shallower radial projection than the main lugs, and as illustrated, extend in an angular direction beyond the outer terminal portions of each lug. Thus, the primary lug 50 has two auxiliary lugs 50$^c$ and 50$^d$ projecting from its opposite ends. The lug 52 has an auxiliary lug 52$^c$ projecting from one end thereof and the lug 54 has an auxiliary lug 54$^c$ projecting from its outer terminal end. The arcuate auxiliary lugs 52$^c$ and 54$^c$ are subtended by angles $N_1$ and $O_1$. A common auxiliary lug 55 subtended by an angle $K_1$ connects the inner adjacent terminal ends of the ribs 52 and 54. These auxiliary lugs have an inner edge which lie on a common circle $C_c$ having a diameter $D_6$ less than the diameter $D_5$ of the circle $C_a$ of the locking ribs 32, 34 and 36. Thus, the auxiliary lugs underlie the locking ribs on the container neck when the main locking lugs are in registry with the gaps in the neck of the container. Accordingly, even if a child is successful in removing the tear band and rotating the cap to its ready open position, the cap will resist separation from the container if a purely axial force is applied thereto. In order to remove the cap when the lugs are in this position, it is necessary to apply a tilting force to the cap in the manner shown in FIG. 13. By this action, the auxiliary ribs are deflected sufficiently to release from the locking rib, the portion of the cap diametrically opposed from the thumb tab T engaging the shoulder 31 to provide a lever action when the cap is tilted.

The cap is also provided with an annular sealing flange 56 on its inner periphery adjacent the juncture of the skirt and the top which has a predetermined radial inward projection in relation to the outer terminal neck portion 18$^c$ to form a seal therewith when the cap is fully seated on the container. Thus the diameter $D_7$ of the inner edge of the flange 56 is slightly smaller than the diameter $D_3$ of the upper neck portion 18$^c$. Note that the axial depth H of the skirt measured from the inside of the top to the lower terminal edge thereof is slightly greater than the axial height $H_1$ of the container neck measured from the top to the shoulder 31$^a$ at the juncture of the lower and intermediate neck portions to permit seating of the cap and engagement of the locking lugs under the locking bead.

The container-closure assembly includes another child resistant feature in the form of a security band 12$^b$ detachably secured to the lower terminal edge of the skirt of the cap along a circumferential area 60 of reduced cross section at the juncture of the tear band and skirt.

Figure 11:
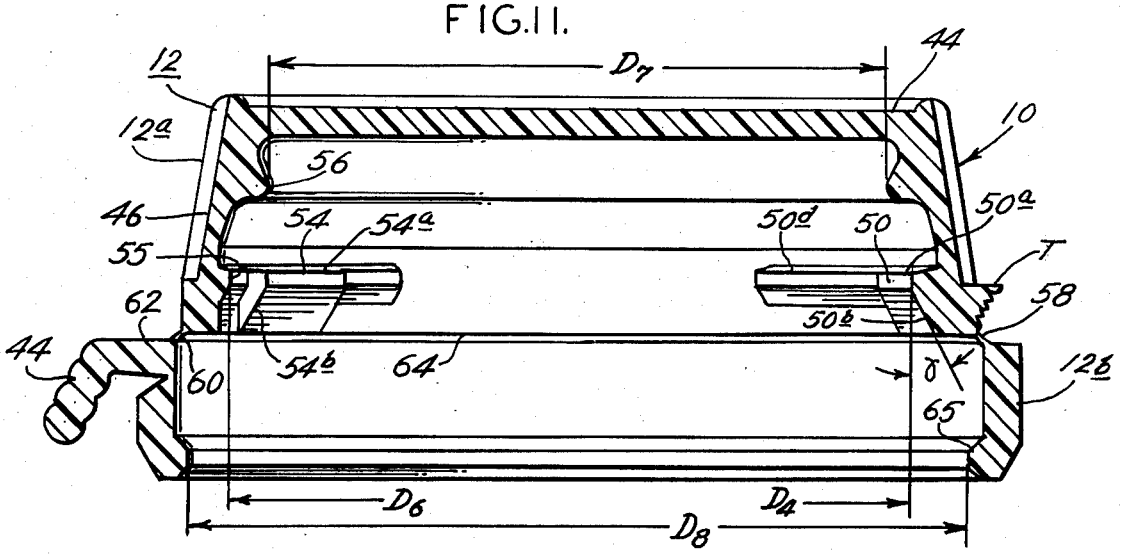
FIG. 11 is an enlarged transverse sectional view of the closure.

The tear band 12$^b$ is provided with a tab 44 projecting radially outwardly and downwardly to provide gripping means for the user to initiate removal of the tear band. As illustrated, the tab 44 is disposed at the end of a strip 62 forming part of the tear band defined by a score line 64 extending parallel to the weakened scored area 60 for part of the circumference of the tear band. The score line 60 angles off obliquely to the terminal edge of the tear band as illustrated in FIG. 3. As illustrated in FIGS. 4 and 11, the tear band terminates at its lower edge in a radially inwardly directed flange 65 which extends the entire circumference of the band and engages in the groove 30 closely overlying the shoulder 29. The flange defines a pocket closely embracing the band 22 preventing removal by a prying action. Thus, the inner edge of the flange has a diameter $D_8$ less than the diameter $D_1$ of the band 22 on the container neck.

Figure 12:
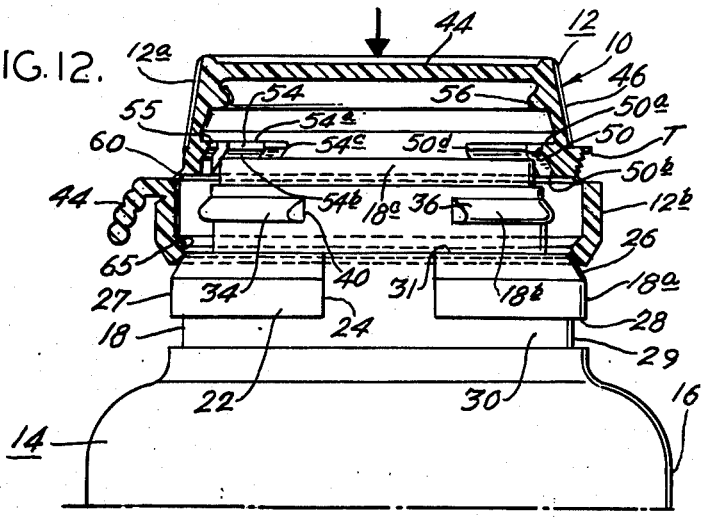
FIG. 12 is a transverse sectional view of the closure and a side elevational view of the container neck showing the closure position just prior to assembly to the container.

The flange diameter $D_8$ is slightly greater than the smallest diameter of the sloping surface 29 and is beveled so that it cams over the band when the closure is applied to the container in the manner illustrated in FIG. 12.

The security band thus provides a child resistant and tamperproof feature when it is initially disposed by the retailer to the consumer. When the security band is intact, it indicates that the container contents have not been disturbed. Further, since the lower terminal edge of the band closely overlies the shoulder 28, it is virtually impossible to remove the closure by prying. Now when it is desired to remove the closure, the user simply grasps the tab and pulls it to the right, with respect to FIG. 3. This action tears the scoring along the lines 58 and 62. Further pulling of the tab, of course, severs the circumferential score line 58 to completely remove the tear band. Thereafter, removal of the tear band exposes the indicator gap 24 thus permitting the user to rotate the cap to align the thumb tab with the gap 24 which positions the primary locking lugs in registry with the gaps in the container neck portion. In this position, it may be supported in one hand and thumb of the user pressed upwardly on the thumb tab to tilt the cap in the manner illustrated in FIG. 13. The ribs 32, 34 and 36 have rounded terminal ends to ease passage of lugs therethrough. This arrangement provides a truly tamperproof construction and one which is also child resistant since the cap portion can not be removed until the tear band has been severed in the manner described above.

Consider now the manufacture, assembly and use of a container-closure assembly in accordance with the present invention. As noted above, the closure 12 and container 16 may be molded by conventional techniques of various types of thermoplastic resins to the configuration shown in the drawings. After filling the container, the closure may be assembled by automatic equipment simply by positioning it over the container finish in the manner illustrated in FIG. 12. Note that in this position the flange of the tear band rests on the sloping shoulder of the band 18 on the container neck, and the locking lugs are positioned slightly above the top edge of the container neck. Application of an axial downward force on the top of the cap portion flexes the tear band outwardly so that it can pass over the band 18 and the flange snap in place in the groove 30. During downward movement of the closure, the locking lugs cam over the locking bead on the intermediate neck portion 18$^b$. When the closure is fully seated, as illustrated in FIG. 4, the sealing rim adjacent the inside top of the closure presses lightly against the terminal neck portion 18$^c$ to provide an effective seal preserving the contents of the container against deterioration. As noted above, the tear band overlies the indicator gap 24 and thus one element of the indicia means is obscured. As noted above, since the gap 24 is hidden from view, and since this comprises half of the indicia means for aligning the locking lugs with their corresponding gaps, it is an added child resistant feature of the assembly. Of course, destruction of the tear tab is necessary to gain access to the contents and this then also adds a tamperproof evident feature.

When it is desired to gain access to the contents, the tear tab is removed in the manner described above. The cap portion is then rotated to align the indicia means on the cap with the indicator gap 24 on the container. The user then presses the thumb tab upwardly to tilt the cap in the manner shown in FIG. 13.

Set forth below is an example of a container-closure assembly made in accordance with the present invention, listing specific diameter relationships for the locking lugs, locking beads and other interengaging elements of the closure and container neck finish. These relationships are by way of example only, it being noted that in larger or smaller sizes, the relative dimensions of the parts may vary from those set forth below.

| Angle | Part Designation and number | Specific Dimension |
|---|---|---|
| $\alpha$ | surface 26 | 30° |
| A | gap 38 | 26° |
| B | gap 42 | 26° |
| C | gap 40 | 54° |
| E | primary locking rib 34 | 108° |
| F | primary locking rib 36 | 108° |
| G | primary rib 32 | 38° |
| $\beta$ | surfaces 32$^a$, 34$^a$, 36$^a$ | 37° |
| $A_1$ | primary lug 52 | 25° |
| $B_1$ | primary lug 54 | 25° |
| $C_1$ | primary lug 50 | 52° |
| $K_1$ | angular spacing between lugs 52 and 54 | 40° |
| $L_1$ | auxiliary lug 50$^c$ | 34° |
| $M_1$ | auxiliary lug 50$^c$ | 34° |
| $N_1$ | auxiliary lug 52$^c$ | 15° |
| $O_1$ | auxiliary lug 54$^c$ | 15° |
| $P_1$ | auxiliary lug 55 | 40° |

| Diameter | Part Designation and number | Specific Dimension |
|---|---|---|
| D | band 22 | 1.367 ins. |
| $D_1$ | groove 30 | 1.321 ins. |
| $D_2$ | intermediate neck 18$^b$ | 1.106 ins. |
| $D_3$ | lower neck 18$^c$ | 1.044 ins. |
| $D_4$ | primary lugs 50, 52 & 54 | 1.111 ins. |
| $D_5$ | locking ribs 32, 34 & 36 | 1.186 ins. |
| $D_6$ | auxiliary lugs 50$^c$, 52$^c$, 54$^c$ and 55 | 1.161 ins. |

| Axial Height | Part Designation and number | Specific Dimension |
|---|---|---|
| H | cap axial height | 0.313 ins. |
| $H_1$ | container neck axial height | 0.296 ins. |

Figure 14:
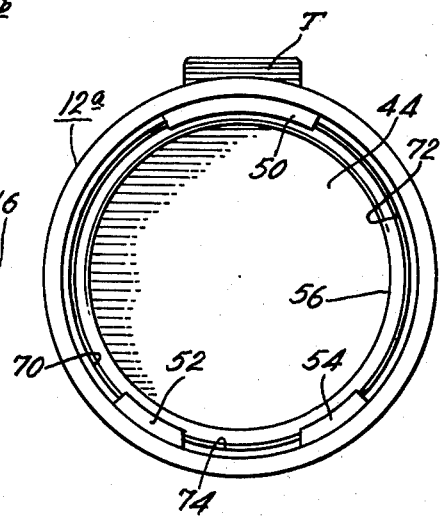
FIG. 14 shows a modification having a full auxiliary locking lug.

There is illustrated in FIG. 14 a modified form of closure in accordance with the present invention. The basic configuration of the cap is similar to that described previously, and accordingly, the same reference numerals have been applied to parts thereof which are the same. Thus, the cap includes a top 44 having a depending skirt and a series of radially inwardly projecting, circumferentially spaced primary locking lugs 50, 52 and 54. This embodiment also includes auxiliary locking means comprising a series of three lugs 70, 72 and 74 which as in the previously described embodiment, are of a shallower radial projection than the primary locking lugs and in the present instance extend continuously circumferentially between the primary lugs as illustrated. Thus, the auxiliary lug 70 extends from one terminal end of the primary lug 50 continuously to the terminal end of the primary lug 52. The auxiliary lug 72 likewise extends from the opposite terminal end of the primary lug 50 to the lug 54. The auxiliary lug 74 connects the adjacent terminal ends of the primary lugs 52 and 54. The primary and auxiliary locking lugs of this embodiment are in the same relation in regard to diametric dimension to that set forth in the specific example on page 23.

The principal embodiment of the invention illustrated in FIGS. 1–13 inclusive which incorporates partial auxiliary locking lugs is best suited for plastic materials having a high density such as a high density polyethylene whereas the embodiment of FIG. 14 incorporating a so-called full auxiliary locking lug is for closures made of a lower density plastic material which is more pliable and flexible. In this manner it is believed that the removal force for each closure is substantially the same.

While preferred embodiments of the present invention have been described in detail, various modifications, alternations and changes may be made without departing from the spirit and score of the present invention as defined in the appended claims.

I claim:

1. A closure for a container having a neck with an access opening therein and means defining a locking rib on the outer surface of the neck interrupted at least at two circumferentially spaced locations to define gaps therein of predetermined differing arcuate dimensions, said closure including a cap having a top, a skirt depending from the outer edge of the top and at least a pair of primary locking lugs projecting radially inwardly from the skirt which in all positions, except one, engage under said locking rib to secure the cap in place, said primary lugs being of an arcuate span and circumferential spacing to register with said gaps in said one position and at least one auxiliary releasable locking lug of a shallower radial projection than said primary lugs engaging under said bead when said cap is in said one position, said auxiliary lug operable to snap over said bead in said one position when said cap is tilted relative to the neck of the container.

2. A closure as claimed in claim 1 wherein said locking rib has a downwardly and outwardly divergent sloping surface and said lugs have a complementary sloping surface to permit engagement of the lugs over the ribs by a camming action.

3. A closure as claimed in claim 1 including a circumferentially extending sealing bead on the inner periphery of said skirt adjacent the juncture of said top and skirt engageable with the side wall of the neck of the container when the cap portion is in a seated, locked position on the container.

4. A closure as claimed in claim 1 wherein the container includes a band extending circumferentially about the neck portion and said closure includes a tear band detachably secured to the lower edge of the skirt of said cap having a locking flange at its lower terminal edge engaging in a groove below said band.

5. A closure as claimed in claim 4 wherein said band is interrupted to define an indicator gap and said cap is provided with a thumb tab projecting outwardly from said skirt, said lugs being in registry with said gaps when said thumb tab and indicator gap are aligned.

6. A closure as claimed in claim 1 made of a resilient, flexible material, such as a thermoplastic resin.

7. A closure as claimed in claim 1 wherein the auxiliary locking lug extends circumferentially and continuously between said primary locking lugs.

8. A closure as claimed in claim 1 wherein at least one of the auxiliary locking lugs extends circumferentially from opposite terminal ends of one of said primary locking lugs for a given angular extent and terminates short of said other primary locking lug.

9. A closure for a container having a neck with an access opening therein and means defining a locking rib on the outer surface of the neck interrupted at circumferentially spaced locations to define at least three gaps therein of predetermined differing arcuate dimensions, two of said gaps being of approximately equal arcuate dimension and the third gap being of a greater arcuate dimension, said gaps being disposed about the circular neck of the container so that said two gaps are disposed in one semicircular segment of said neck and said third gap is disposed in the other semicircular segment, said closure including a cap having a top, a skirt depending from the outer edge of the top and at least a pair of primary locking lugs projecting radially inwardly from the skirt which in all positions, except one, engage under said locking rib to secure the cap in place, said primary lugs being of an arcuate span and circumferentail spacing to register with said gaps in said one position and at least one auxiliary releasable locking lug of a shallower radial projection than said primary lugs engaging under said bead when said cap is in said one position, said auxiliary lug operable to snap over said bead in said one position when said cap is tilted relative to the neck of the container.

10. The combination of a closure and a container having a neck with an access opening therein, means defining a locking rib projecting radially outwardly from said neck interrupted at least at two circumferentially spaced locations to define gaps therein of predetermined differing angular dimensions and a radially outwardly projecting band below said locking rib of a greater diametral dimension than said locking rib to define a stepped configuration, said closure including a cap having a top, a skirt depending from the outer edge of the top and at least a pair of primary locking lugs projecting radially inwardly from the skirt which in all positions, except one, engage under said locking rib to secure the cap in place, said primary lugs being of an arcuate span and circumferential spacing to register with said gaps in said one position and at least one auxiliary releasable locking lug of a shallower radial projection than said primary lugs engaging under said bead when said cap is in said one position, said auxiliary lug operable to snap over said bead in said one position when said cap is tilted relative to the neck of the container, a tear band detachably secured to the lower edge of said skirt having a locking flange at its lower terminal edge engageable in a groove below said band, the diametral dimension of said flange being slightly less than said band and greater than said locking rib to facilitate assembly of said closure to the container.

11. A closure for a container having a neck with a circumferentially extending radially projecting bead having at least one gap therein, said closure comprising a top and a depending skirt, at least one primary locking lug projecting radially from the skirt operable to register with the gap in one removal position and at least one auxiliary locking lug projecting radially from the skirt in the same direction as said primary lug, said auxiliary locking lug being contiguous to one terminal end of said primary locking lug and being of a shallower radial projection than said primary locking lug.

12. A closure as claimed in claim 11 wherein said primary locking lug and auxiliary locking lug lie in a common plane.

13. A closure as claimed in claim 11 where in said primary locking lug and said auxiliary locking lug project radially inwardly from the inner peripheral circumferentially extending surface of said skirt and wherein a circular trace through the inner edge of said primary locking lug is of a smaller diameter than a circular trace through the inner peripheral edge of said auxiliary locking lug.

14. A closure as claimed in claim 11 wherein the bead has a plurality of gaps and wherein said closure includes a plurality of circumferentially spaced primary locking lugs and wherein said auxiliary locking lugs extend for the full circumferential distance between adjacent primary locking lugs.

15. A closure for a container having a neck with a circumferentially extending radial bead with at least two circumferentially spaced gaps therein, said closure comprising a top and a depending skirt, at least a pair of circumferentially spaced primary locking lugs projecting radially from the skirt operable to register with the gaps in one removal position and at least one auxiliary locking lug projecting radially from the skirt in the same direction as said primary locking lugs, said auxiliary locking lug disposed adjacent a primary locking lug and being of a shallower radial projection than said primary locking lug.

16. A closure as claimed in claim 15 including segmental auxiliary locking lugs projecting from and contiguous to outer terminal ends of said primary locking lugs.

17. The combination of a closure and a container having a neck with an access opening therein and means defining a locking rib on the surface of the neck interrupted at least at one location to define a gap therein of predetermined arcuate dimension, said closure having a top, a circumferential skirt depending from the top and at least one primary locking lug projecting radially from the skirt which in all positions, except one, engages under said locking rib to secure the cap in place, said primary locking lug being of an arcuate span to register with said gap in said one position and at least one auxiliary releasable locking lug contiguous to at least one terminal end of said primary locking lug and of a shallower radial projection than said primary lug engaging under said bead when said cap is in said one position, said auxiliary locking lug operable to snap over said bead in said one position when said cap is tilted relative to the neck of the container.

18. The combination as claimed in claim 17 wherein said bead projects radially outwardly from the neck of the container and said primary and auxiliary locking lugs project radially inwardly from the inner surface of said skirt.

19. The combination as claimed in claim 17 including at least one pair of gaps in said bead and at least a pair of circumferentially spaced primary locking lugs operable to register with said gaps in said one position and wherein said auxiliary locking lug extend circumferentially between the terminal ends of said primary locking lugs.

20. The combination as claimed in claim 17 including segmental auxiliary locking lugs contiguous to terminal ends of said primary locking lug.

21. The combination of a closure and a container having a neck with an access opening therein and means defining a locking rib on the surface of the neck interrupted at least at one location to define a gap therein of predetermined arcuate dimension, said closure having a top, a circumferential skirt depending from the top and at least one primary locking lug projecting radially from the skirt which in all positions, except one, engages under said locking rib to secure the cap in place, said primary locking lug being of an arcuate span to register with said gap in said one position and means providing auxiliary releasable locking means adjacent at least one terminal end of said primary locking lug when said primary locking is disposed in said one position, said means providing a small seating force releasable upon tilting movement of said closure relative to the neck of the container.

* * * * *